US008899722B2

(12) United States Patent
O'Hara et al.

(10) Patent No.: US 8,899,722 B2
(45) Date of Patent: Dec. 2, 2014

(54) WIPING ASSEMBLY FOR A FLUID EJECTION DEVICE

(71) Applicant: Hewlett-Packard Development Company, L.P., Fort Collins, CO (US)

(72) Inventors: Steve A. O'Hara, Vancouver, WA (US); Gene D. Jones, Vancouver, WA (US); Scott Martin, Vancouver, WA (US); Sierra Lynn Triebe, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 83 days.

(21) Appl. No.: 13/740,492

(22) Filed: Jan. 14, 2013

(65) Prior Publication Data

US 2014/0198154 A1 Jul. 17, 2014

(51) Int. Cl.
*B41J 2/165* (2006.01)

(52) U.S. Cl.
CPC ..... *B41J 2/16544* (2013.01); *B41J 2/16535* (2013.01); *B41J 2/16585* (2013.01); *B41J 2002/1655* (2013.01)
USPC ..... 347/33; 347/32; 347/22

(58) Field of Classification Search
CPC ..... B41J 2/16535; B41J 2/16544; B41J 2/16538; B41J 2/16547; B41J 2/16517
USPC ..... 347/33, 32, 22
See application file for complete search history.

(56) References Cited

U.S. PATENT DOCUMENTS

| | | | | |
|---|---|---|---|---|
| 6,249,662 | B1 | 6/2001 | Lee | |
| 7,308,225 | B2 | 12/2007 | Kaiho | |
| 7,344,222 | B2 * | 3/2008 | Nakamura | 347/33 |
| 7,347,318 | B2 | 3/2008 | Kato | |
| 8,342,639 | B2 * | 1/2013 | Inoue | 347/33 |
| 2009/0289993 | A1 * | 11/2009 | Yamaguchi | 347/33 |
| 2010/0315463 | A1 * | 12/2010 | Escude et al. | 347/33 |
| 2013/0250000 | A1 * | 9/2013 | Yamamoto | 347/33 |

FOREIGN PATENT DOCUMENTS

JP 2000276002 10/2000

* cited by examiner

*Primary Examiner* — Henok Legesse

(57) ABSTRACT

A wiping assembly includes an endless belt and a plurality of rollers about which the belt is mounted. A first roller mounts a first end of the belt adjacent a first end of a belt zone while a second roller is adjacent at an opposite, second end of the belt zone. A third roller mounts a second end of the belt and is located at an intermediate position along a first orientation between the respective first and second ends of the belt zone. The third roller is translatable along the first orientation while the first roller and the second roller are non-translatable along the first orientation. The third roller is biased toward the first end of the belt zone to apply tension on the belt.

20 Claims, 9 Drawing Sheets

WIPING ASSEMBLY FOR A FLUID EJECTION DEVICE

BACKGROUND

Printing systems typically perform routine maintenance to achieve optimal printing performance. For some types of printers, such as those including fluid ejection devices, such maintenance frequently includes spitting and wiping among other types of maintenance.

DETAILED DESCRIPTION

Figure 1:
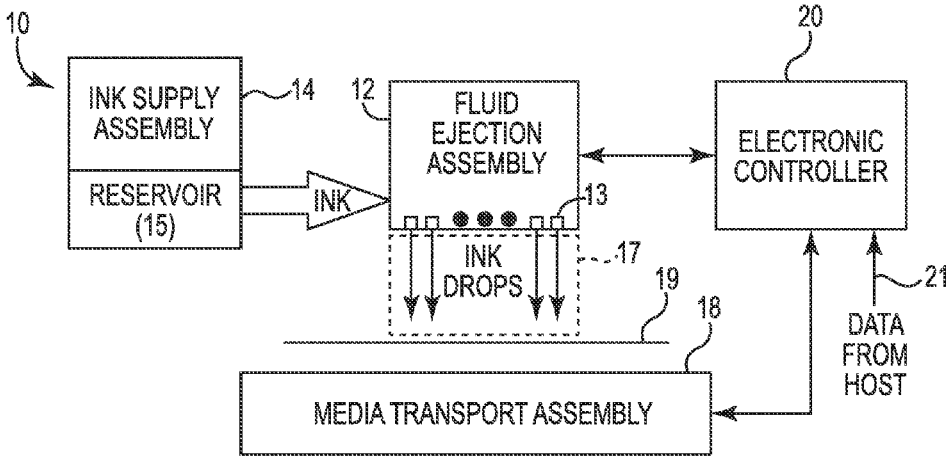
FIG. 1 is a block diagram schematically illustrating a printing system, according to one example of the present disclosure.

In the following detailed description, reference is made to the accompanying drawings which form a part hereof, and in which is shown by way of illustration specific examples which may be practiced. In this regard, directional terminology, such as "top," "bottom," "front," "back," "leading," "trailing," etc., is used with reference to the orientation of the Figure(s) being described. Because components in these examples can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense.

At least some examples of printing systems in the present disclosure are directed to a wiping assembly to wipe a fluid ejection assembly, such as a printhead assembly. In some examples, the wiping assembly includes an endless belt mounted about an array of rollers with a portion of the belt on one of the rollers being used for wiping the fluid ejection assembly. In some examples, at least some features of the wiping assembly minimize lateral shifting (i.e. walking) of the belt relative to the rollers on which the belt is mounted. In some examples, this lateral shifting of the belt is minimized via a particular arrangement the rollers and a particular location at which tension is applied to the belt (about the rollers), which in turn reduces the overall tension applied on the belt about the rollers. In some examples, such lateral shifting of the belt is minimized via barriers positioned adjacent side edges of the belt.

Minimizing lateral walking of a wiping belt reduces damage to such belts that might otherwise occur from such lateral walking and consequently better protects the health and integrity of nozzles of a fluid ejection device in selective proximity to the wiping assembly. Moreover, by reducing the overall tension along the belt, less fatigue is experienced by support components and a greater reliability is achieved in advancing a portion of the belt about the rollers when it is time to reposition the belt along the rollers.

In one example, a wiping assembly comprises an array of rollers about which an endless belt is mounted with the array of rollers including a first roller, a second roller, and a third roller. The first roller mounts a first end of the mounted belt adjacent a first end of a belt zone while the second roller is located adjacent a second end of the belt zone. The third roller mounts a second end of the belt and is located at an intermediate position along a first orientation between the respective first and second ends of the belt zone. The third roller is translatable along the first orientation while both the first roller and the second roller are non-translatable along the first orientation. The third roller is biased toward the first end of the belt zone (i.e. away from the second end of the belt zone) to apply tension on the belt.

In one aspect, by applying a biasing force to a single roller (i.e., the third roller) to apply tension to the belt (instead of applying a biasing force simultaneously to multiple rollers), the overall friction applied by the tensioning mechanism is reduced over the entire path of the belt. This, in turn, enables the wiping assembly to better react to changes in tension that occur during use of the wiping assembly and optimizes the ability of a drive system to drive the belt about the rollers when it is desired to periodically translate the belt along the rollers.

In some examples, the rollers of the array are arranged in a configuration by which the orientation of the belt varies each time the belt extends about one of the rollers of the array. In one aspect, this variable-orientation configuration enables providing a longer belt in a given space than if the belt extended solely in a single orientation. This increased length, in turn, results in greater longevity of a wiping assembly before replacement of a belt would occur. Indeed, in some examples, these configurations enable a sufficient length of the belt to be provided that the belt is considered to last a lifetime of the printing system in which the belt is installed. By doing so, one type of maintenance procedure is avoided.

In some examples, the variable-orientation configuration of the belt between the first and second ends of the belt zone is sometimes referred to as a serpentine configuration.

These example printing systems, and other example printing systems, are described and illustrated in association with FIGS. 1-15.

FIG. 1 is a block diagram schematically illustrating a printing system 10, according to one example of the present disclosure. As shown in FIG. 1, printing system 10 includes a fluid ejection assembly 12, an ink supply assembly 14, a media transport assembly 18, and an electronic controller 20. In one example, the fluid ejection assembly 12 includes at least one fluid ejection device which ejects drops of ink through orifices or nozzles 13 and toward a print media 19 so as to print onto print media 19. In one example, the at least one fluid ejection device comprises an inkjet printhead. In some examples, the at least one fluid ejection device comprises other types of printheads. Print media 19 is any type of suitable sheet material, such as paper, card stock, envelopes, labels, transparencies, and the like. Typically, nozzles 13 are arranged in at least one column or at least one array such that properly sequenced ejection of ink from nozzles 13 causes characters, symbols, and/or other graphics or images to be printed upon print media 19 as relative movement occurs between fluid ejection assembly 12 and print media 19.

In one aspect, ink supply assembly 14 supplies ink to fluid ejection assembly 12 and includes a reservoir 15 for storing ink. As such, ink flows from reservoir 15 to fluid ejection assembly 12, such as an inkjet printhead assembly.

In one example, fluid ejection assembly 12 and ink supply assembly 14 are housed together in a single housing. In some examples, ink supply assembly 14 is separate from fluid ejection assembly 12 but still directly communicates ink to the fluid ejection assembly 12 via a releasable connection with the ink supply assembly 14 being mounted directly above and at least partially supported by the printhead assembly 12. This example is sometimes referred to as an on-axis configuration of the ink supply assembly 14.

In some examples, the ink supply assembly 14 is positioned remotely from the fluid ejection assembly 12, with the ink supply assembly 14 communicating ink to the fluid ejection assembly 12 via an array of supply tubes. This example is sometimes referred to as an off-axis configuration of the ink supply assembly 14.

Media transport assembly 18 positions print media 19 relative to fluid ejection assembly 12. Thus, a print zone 17 is defined adjacent to nozzles 13 in an area between fluid ejection assembly 12 and print media 19. In one example, fluid ejection assembly 12 is a non-scanning-type fluid ejection assembly, such as a page wide array of fluid ejection devices. In one aspect, the non-scanning-type fluid ejection assembly does not move laterally across a page during printing. Rather, media transport assembly 18 advances or positions print media 19 relative to the stationary fluid ejection assembly 12.

In one example, electronic controller 20 communicates with at least fluid ejection assembly 12 and media transport assembly 18. In some examples, electronic controller 20 receives data 21 from a host system, such as a computer, and includes memory for temporarily storing data 21. Typically, data 21 is sent to printing system 10 along an electronic, infrared, optical or other information transfer path. Data 21 represents, for example, an image, a document, and/or file to be printed. As such, data 21 forms a print job for printing system 10 and includes print job commands and/or command parameters.

In one example, electronic controller 20 provides control of fluid ejection assembly 12 including timing control for ejection of ink drops from nozzles 13. As such, electronic controller 20 operates on data 21 to define a pattern of ejected ink drops which form characters, symbols, and/or other graphics or images on print media 19. Timing control and, therefore, the pattern of ejected ink drops, is determined by the print job commands and/or command parameters. In some examples, logic and drive circuitry forming a portion of electronic controller 20 is located on fluid ejection assembly 12. In some examples, at least some of this logic and drive circuitry is located remotely from fluid ejection assembly 12.

Figure 2A:
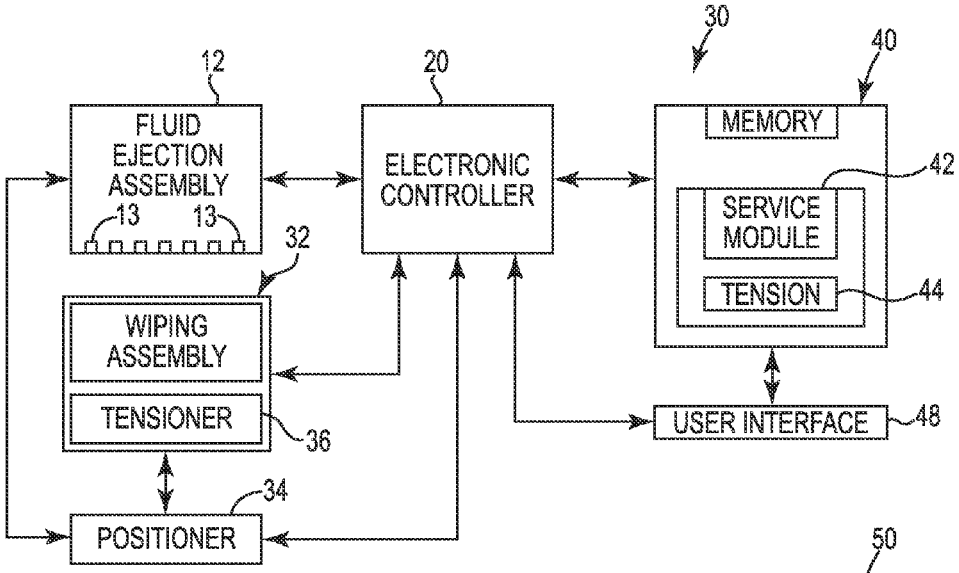
FIG. 2A is a block diagram schematically illustrating a printing system, according to one example of the present disclosure.

FIG. 2A is a block diagram schematically illustrating a printing system 30, according to one example of the present disclosure. In one example, the printing system 30 includes at least substantially the same features and attributes as printing system 10 as previously described in association with FIG. 1, with like components identified via like reference numerals.

In one example, as shown in FIG. 2A, printing system 30 includes fluid ejection assembly 12, electronic controller 20, wiping assembly 32, positioner 34, and memory 40. In general terms, wiping assembly 32 is provided for performing periodic maintenance operations on fluid ejection assembly 12, such as inkjet printheads. In one example, wiping assembly 32 is stationary and fluid ejection assembly 12 is moved (via positioner 34 in FIG. 2A) to position at least the fluid ejection assembly 12, and in particular at least nozzles 13, into wiping relation to the wiping assembly 32. In this example, positioner 34 comprises a carriage assembly for moving fluid ejection assembly 112 into a servicing position, among other possible locations.

In some examples, fluid ejection assembly 12 is stationary and wiping assembly 12 is moved into wiping relation to at least the nozzles 13 of the fluid ejection assembly 12. In these examples, positioner 34 comprises a sled or tray for moving the wiping assembly 32 into a servicing position relative to fluid ejection assembly 12. In one aspect, positioner 34 supports wiping assembly 32 and is movable relative to the fluid ejection assembly 12.

In some examples, both the fluid ejection assembly 12 and the wiping assembly 32 are movable with respect to each other.

In some examples, whether wiping assembly 32 is stationary, the fluid ejection assembly 12 is stationary, or both wiping assembly 32 and the fluid ejection assembly 12 are both movable relative to each other, the positioner 34 selectively urges at least a portion of wiping assembly 32 and at least the nozzles 13 of the fluid ejection assembly 12 into biased contact against each other during a wiping action relative to nozzles 13. In one example, the biasing force is provided via at least one spring such that contact of portion of wiping assembly 32 relative to fluid ejection assembly 12 results in the spring urging the wiping assembly 32 and the fluid ejection assembly 12 against each other.

In some examples, wiping assembly 32 includes a tensioner 36 to apply tension on a belt of the wiping assembly 32 that is used to wipe the fluid ejection assembly 12. In some examples, the tensioner 36 is comprised solely of mechanical elements, such as springs, brackets, etc. In some examples, the tensioner 36 includes at least some mechanical elements and at least some electro-mechanical elements such that the tension is electronically adjustable via controller 20 as described further below in relation to service module 42.

With further reference to FIG. 2A, in some examples, printing system 30 includes the previously mentioned controller 20 and memory 40.

In one example, controller 20 comprises at least one processor and associated memories to generate control signals directing operation of at least some components of printing system 30 of FIG. 2A and/or printing system 10 of FIG. 1. In particular, in response to or based upon commands from a user interface 50 and/or machine readable instructions (including software) contained in the memory 40 associated with controller 20, controller 20 generates control signals directing operation of printing systems 10, 30 shown in FIGS. 1 and 2A, respectively. In one example, controller 20 is embodied in a general purpose computer.

For purposes of this application, in reference to the controller 20, the term "processor" shall mean a presently developed or future developed processor (or processing resources) that executes sequences of machine readable instructions (such as but not limited to software) contained in a memory. Execution of the sequences of machine readable instructions causes the processor to perform actions, such as operating printing system 30 to cause wiping assembly 32 to be properly tensioned and to wipe a portion of fluid ejection assembly 12, in the manner described in the examples of the present disclosure. The machine readable instructions may be loaded in a random access memory (RAM) for execution by the processor from their stored location in a read only memory (ROM), a mass storage device, or some other persistent storage or non-volatile form of memory, as represented by memory 40. In one example, memory 40 comprises a computer readable medium providing non-volatile storage of the machine readable instructions executable by a process of controller 20. In other examples, hard wired circuitry may be used in place of or in combination with machine readable instructions (including software) to implement the functions described. For example, controller 20 may be embodied as part of at least one application-specific integrated circuit (ASIC). In at least some examples, the controller 20 is not limited to any specific combination of hardware circuitry and machine readable instructions (including software), nor limited to any particular source for the machine readable instructions executed by the controller 20.

In one example, memory 40 stores a service module 42 including machine readable instructions for directing components of printing system 30 to service fluid ejection assembly 12. In some examples, service module 42 includes a tension function 44. In some examples, the tension function 44 controls operation of tensioner 36 to apply a desired tension to a belt of the wiping assembly 32. In one aspect, this tensioning includes applying tension via electro-mechanical elements to a center roller of a plurality of rollers of the wiping assembly 32 to cause adequate tension to periodically drive the belt about the rollers while minimizing lateral walking of the belt relative to a length of each of the respective rollers.

Figure 2B:
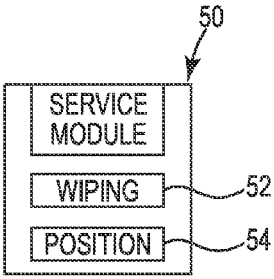
FIG. 2B is a block diagram schematically illustrating a service module of a printing system, according to one example of the present disclosure.
Figure 2B:
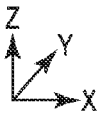

In one example, in cooperation with controller 20 and memory 40, user interface 48 comprises a graphical user interface or other display that provides for the simultaneous display, activation, and/or operation of various components, functions, features, and modules of printing system 10 or printing system 30, described in association with at least FIGS. 1-2A.

FIG. 2B is a block diagram schematically illustrating a service module 50 of a printing system, according to one example of the present disclosure. In one example, service module 50 forms part of a printing system like printing system 30 and is provided in addition to service module 42 that was previously described and illustrated in association with FIG. 2A. In some examples, as shown in FIG. 2B, service module 50 includes a wiping function 46 to control wiping operations via wiping assembly 32 and/or a position function 47 to control, via positioner 34, the positioning of wiping assembly 32 and fluid ejection assembly 12 relative to each other.

Figure 3:
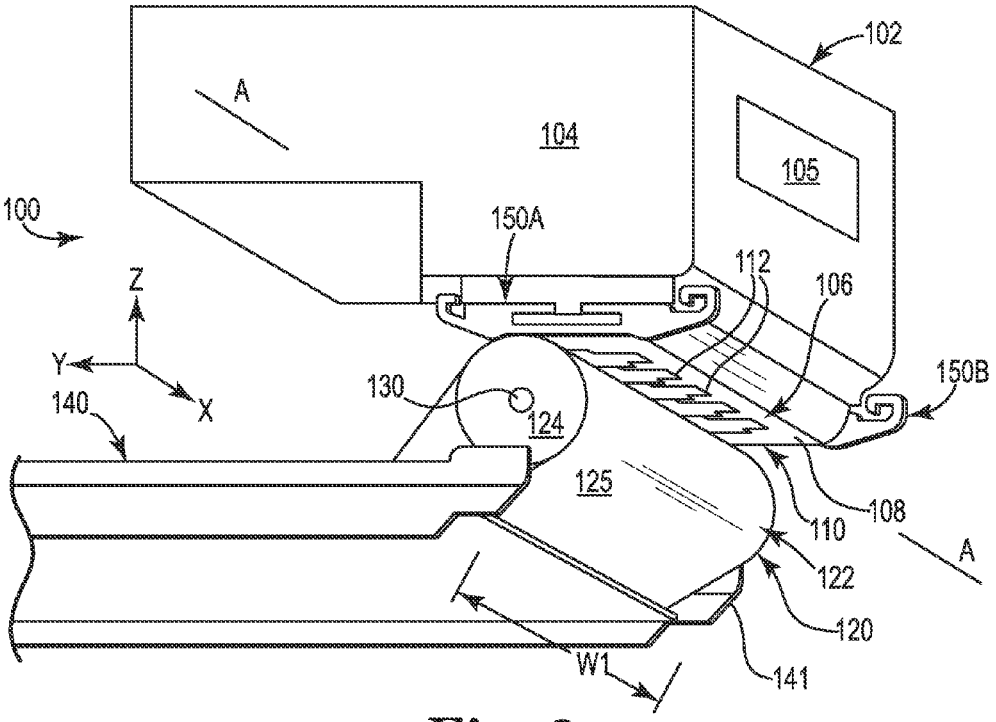
FIG. 3 is a perspective view schematically illustrating a printing system, according to one example of the present disclosure.

FIG. 3 is a diagram including a perspective view schematically illustrating a printing system 100, according to one example of the present disclosure. In one example, printing system 100 comprises at least some of substantially the same features and attributes as printing systems 10, 30 as previously described in association with FIGS. 1-2B.

As shown in FIG. 3, printing system 100 includes a fluid ejection assembly 102 including a housing 104, a headland region 106, and circuitry 105 in communication with operative components of headland region 106. In one example, the headland region 106 includes an array 110 of printheads 112 which are supported by and at least partially surrounded by a shroud 108. In some instances, the headland region 106 can be referred to as a printhead region which includes the printheads 112 and the shroud 108.

In some examples, the array 110 comprises a page wide array of printheads 112 that extend across a width of a page or sheet of media to be printed on such that fluid ejection assembly 102 remains stationary during printing. In other words, fluid ejection assembly 102 does not scan back-and-forth across the width of the page or sheet of media during printing. In one example, a media has a width of about 8½ inches, while in some examples, the width of media is less than 8½ inches and in some examples, the width of media is greater than 8½ inches.

As further shown in FIG. 3, printing system 100 further comprises a wiping assembly 120 that includes a wiping element 122 for wiping headland region 106 of fluid ejection assembly 102. In one example, as shown in FIG. 2, wiping element 122 includes a generally cylindrical shaped roller 124 supporting a belt 125 of wiping material. In some examples, the belt 125 is made of a web-like material that includes an at least partially absorbent component. In one example, the belt 125 has a width (W1) that is generally the same width or a slightly wider than the headland region 106 of fluid ejection assembly 102. In one example, the belt 125 has a width (W1) of about 10 inches when the headland region 106 is configured to print on media having a width of about 8½ inches.

In one aspect, the roller 124 is supported via a rotatable axle 130 at one end 141 of a sled or tray 140. In some examples, the sled 140 comprises a portion of a positioner, such as the previously described positioner 34 (FIG. 2A).

In general terms, sled 140 is arranged, and roller 124 is supported, so that roller 124 and a width (W1) of belt 125 extend generally parallel to a length or longitudinal axis (A) of array 110 of printheads 112 across headland region 106, as shown in FIG. 3.

As further shown in FIG. 3, in some examples, a pair of elongate guides 150A, 150B are located at opposite ends of printhead region 106 and act to guide wiping element 122 into generally parallel wiping relation to printhead region 106. In one aspect, a longitudinal axis of each guide element 150A, 150B extends generally parallel to a Y orientation (i.e. generally parallel to the Y axis in FIG. 3) along which a media moves (i.e. media movement direction) and along which wiping element 122 moves relative to headland region 106 (or vice versa). Being located at opposite ends of printhead region 106, the guide elements 150A, 150B are spaced apart from each other in an X orientation (generally parallel to the X axis in FIG. 3).

Figure 4:
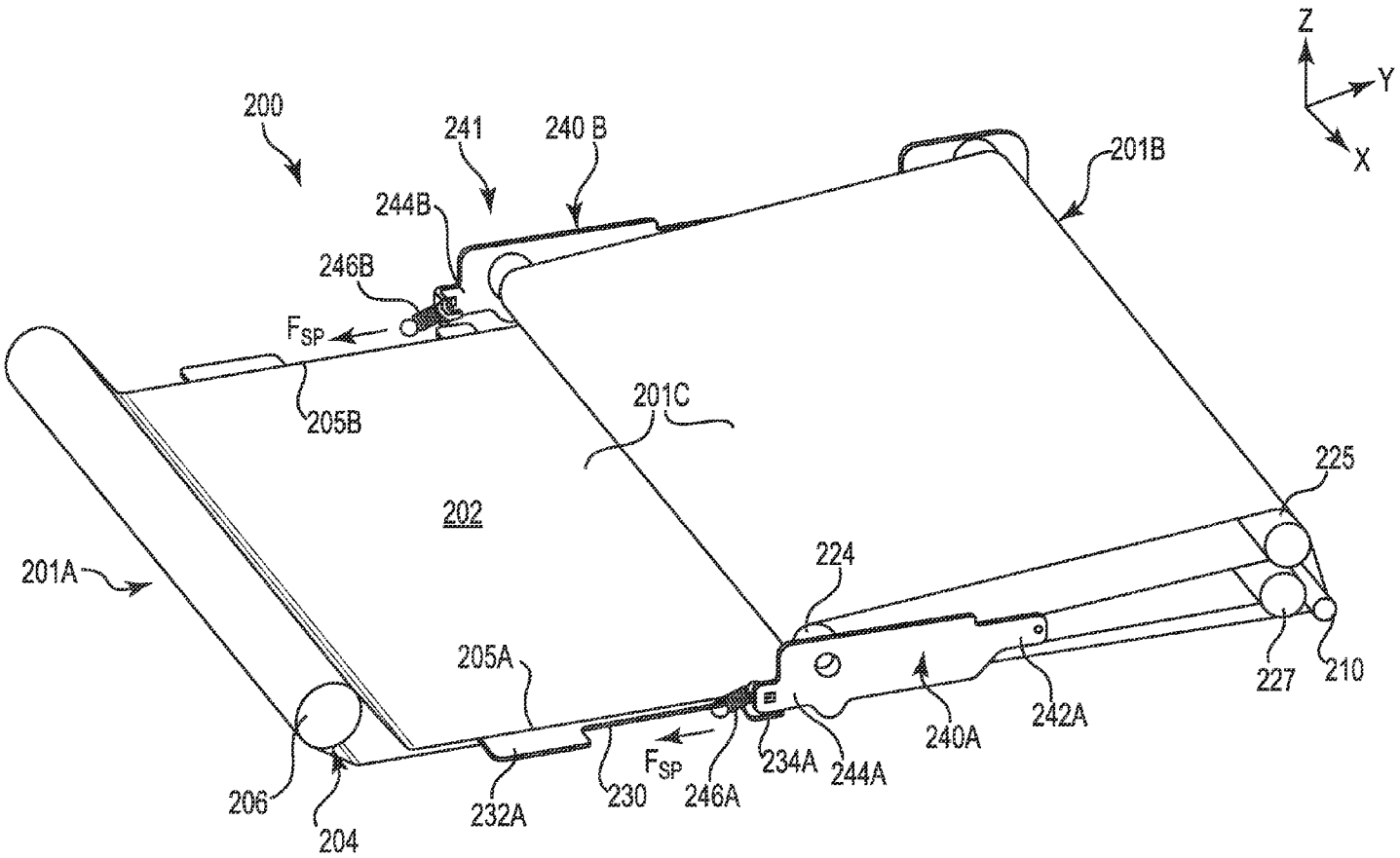
FIG. 4 is a perspective view schematically illustrating a wiping assembly, according to one example of the present disclosure.
Figure 5:
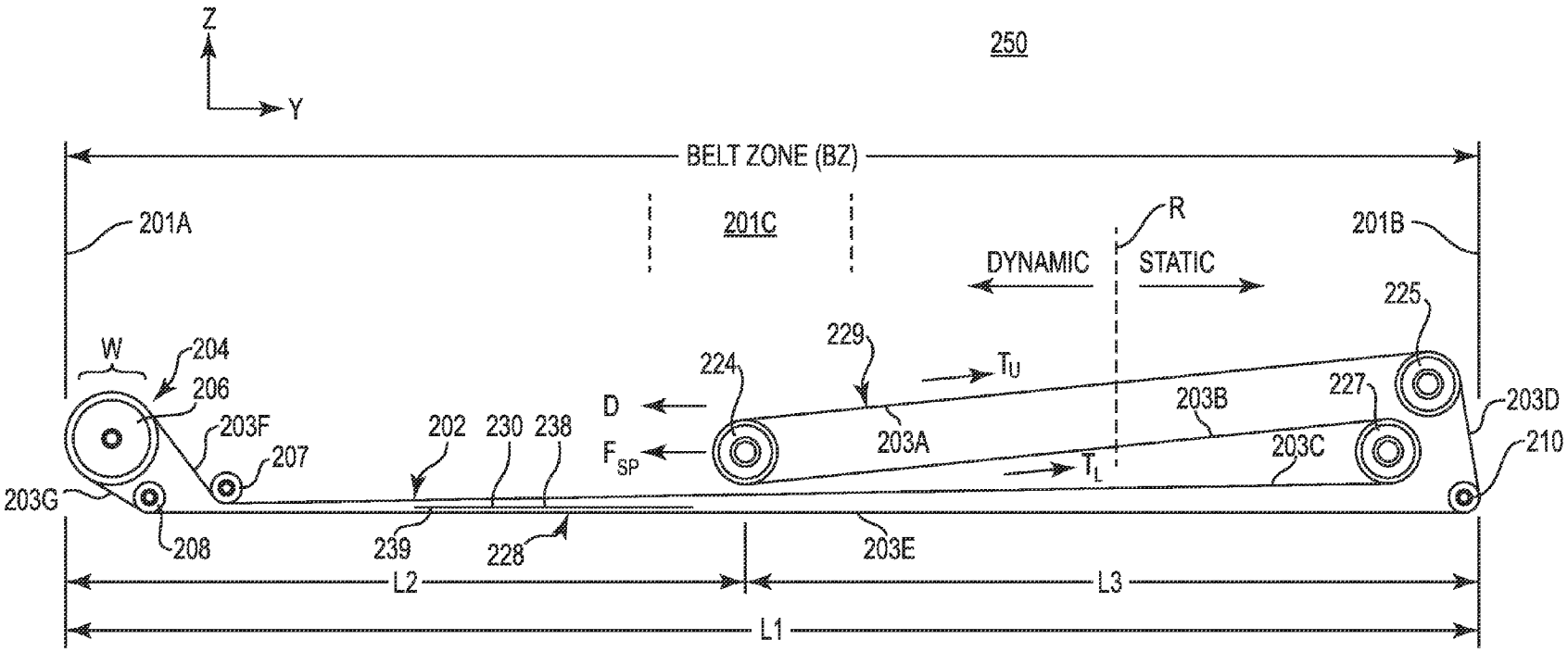
FIG. 5 is a diagram including a side plan view schematically illustrating a wiping assembly, according to one example of the present disclosure.

FIGS. 4-5 schematically illustrate a wiping assembly 200, according to one example of the present disclosure. In one example, wiping assembly 200 comprises at least some of substantially the same features and attributes as portions of printing system 30, such as wiping assembly 32 and service modules 42 and 50, as previously described in association with at least FIGS. 2A and 2B. Moreover, in some examples, a belt 202 and roller 206 of wiping assembly 200 have at least substantially the same features and attributes as belt 125 and roller 124, as previously described and illustrated in association with FIG. 3.

As best seen in the side view in the diagram 250 of FIG. 5, wiping assembly 200 includes an array 204 of rollers including first roller 206, second roller 210, third roller 224, fourth and fifth rollers 225, 227, and sixth and seventh rollers 207, 208. The wiping assembly 200 further includes a belt 202 of material for wiping a surface of a fluid ejection assembly 112. In some examples, an upper portion of first roller 206 defines a wiping zone (W) as shown in FIG. 4 at which a portion of belt 202 is used to wipe the fluid ejection assembly 112.

It will be understood that examples of the present disclosure are not limited solely to the particular arrangement of rollers in array 204 including roller 206, rollers 207, 208, roller 210, and rollers 225, 227, and belt 202. Rather, belt 202 can extend about other arrangements of rollers depending upon the length of belt 202 and/or the size and geometrical shape (available for a given printer) through which the belt 202 can extend.

In one example, as belt 202 extends from roller to roller of the array 204 shown in FIGS. 4-5, and as the belt 202 wraps at least partially about each respective roller, the orientation of belt 202 varies according to the Y and Z orientations. In one example, this variable orientation of belt 202 corresponds to a generally serpentine pattern, as shown in FIGS. 4-5. In general terms, the variable orientations of belt 202 (such as but not limited to a generally serpentine pattern) enables providing a greater length of belt 202 within a given footprint of the wiping assembly 200, which in turn provides greater longevity for the wiping assembly 202 before belt 202 is replaced. Alternatively, this greater longevity allows the use of belt 202 over a lifetime of a printing system in which the wiping assembly 200 is mounted.

In general terms, wiping assembly 200 defines a belt zone BZ through which belt 202 extends about the rollers of array 204. In one aspect, belt zone extends between a first end 201A and an opposite, second end 201B, and includes a generally central region 201C intermediate to the first and second ends 201A, 201B.

In some examples, first roller 206 comprises a drive roller that causes selective partial rotation of belt 202 about first roller 206 to move a used portion of belt 202 out of the wipe zone (W) at the upper portion of the first roller 206, as shown in FIG. 5, for replacement by a fresh portion of belt 202 that enters the wipe zone (W) upon such rotation of drive roller 206. In one aspect, driving rotation of first roller 206 consequently causes rotation of belt 202 about rollers 210, 225, 227, and 224 (and minor rollers 207, 208) that are downstream from first roller 206. As further described below, examples of the present disclosure facilitate regulating a tension on belt 202 before, during, and after such partial rotations to ensure that belt 202 remains properly aligned (along the X orientation) on the rollers about which the belt 202 is mounted.

As shown in FIG. 5, diagram 250 includes portions of belt 202 that are labeled for illustrative purposes and do not correspond to physically distinct or separable segments of the endless belt 202. Rather, because the belt 202 is periodically rotated about first roller 206 such that the belt 202 rotates about the other rollers of array 204, the labeled portions simply refer to portions of belt 202 at a given snapshot of time in between the periodic rotations of belt 202 about the rollers of array 204.

With this in mind, in one example, belt 202 includes belt portion 203A extending from roller 224 to roller 225, belt portion 203B extending from roller 224 to roller 227, belt portion 203C extending from 227 to roller 207, belt portion 203D extending from roller 225 to roller 227, belt portion 203E extending between from roller 210 to roller 208, belt portion 203F extending from roller 206 to roller 226 and belt portion 203G extending from roller 206 to roller 208.

In one example, as shown in FIGS. 4-5, belt portions 203C, 203E extend in a generally horizontal orientation (along the Y orientation) while segment 203D extends in a generally vertical orientation that is generally transverse to the Y orientation to raise a portion of belt 202 into a vertical spaced position above portions 203C, 203E so that belt portions 203A, 203B become generally oriented along the Y orientation in a vertically spaced position above the belt portions 203C, 203E. Among other benefits, this arrangement enables fitting a greater length of a belt within a given footprint, i.e. the space between first and second ends 201A, 201B of the belt zone (BZ).

In one example, as best seen in FIG. 5, a combination of the belt portions 203C, 203E, 204F, 203G defines a first loop portion 228, which extends generally from the first end 201A of belt zone (BZ) to the second end 201B of belt zone BZ. In one aspect, the first loop portion 228 includes the portions of belt 202 extending from roller 210 toward and about roller 206 and from roller 227 toward and about roller 206.

In one example, a combination of the belt portions 203A, 203B generally defines a second loop portion 229 that extends generally from the central region 201C (adjacent roller 224) to the second end 201B of belt zone BZ. In one aspect, the second loop portion 229 includes the portions of belt 202 extending from rollers 225, 227 toward and about roller 224.

In one aspect, the second loop portion 229 is vertically spaced above the first loop portion 228 to provide a generally space-saving configuration of belt 202 along the Y orientation.

In another aspect, a majority of an overall length of the belt defines the first loop portion 228 and therefore, a majority of the overall length of the belt extends generally parallel to a generally horizontal plane extending along the Y orientation.

As further shown in FIG. 5, a biasing force ($F_{SP}$) is applied along the Y orientation and in a first direction (D) to apply tension generally to belt 202 about the array 204 of rollers. In particular, with further reference to FIG. 4, wiping assembly 200 includes a tensioning mechanism 241 that includes a pair of brackets 240A, 240B disposed adjacent opposite side edges 205A, 205B of belt 202. Each bracket 240A, 240B is coupled to a respective one of the opposite ends of roller 224 and a spring 246A, 246B is connected to one end 244A, 244B of a respective one of the brackets 240A, 240B to exert the biasing force (represented by directional force arrow $F_{SP}$) in the D direction along the Y orientation, as shown in FIGS. 4 and 5. Because roller 224 is translatable in the Y orientation, this biasing force ($F_{SP}$) pulls roller 224 in a direction away from the second end 201B of the belt zone BZ and thereby exerts tension on belt 202 throughout the entire belt zone from roller 224 all the way to roller 206 at the first end 201A of the belt zone BZ.

In contrast to the ability of roller 224 to translate along the Y orientation, the other rollers (e.g. rollers 206, 208, 209, 210, 225, and 227) are fixed or static (i.e. not translatable) relative to a Y orientation. In other words, while each roller can rotate about its own respective axle, each respective axle does not translate along any of the X, Y, or Z orientations.

Accordingly, by urging translation of roller 224 in the D direction, along the Y orientation, via a biasing force ($F_{SP}$) such as springs 246A, 246B, tension is applied to belt 202 as represented at least by directional force arrows $T_u$ and $T_L$ shown in FIG. 5.

Because roller 224 is the sole roller 224 that is translatable along the Y orientation while rollers 225, 227, 210, 207, 208, 206 remain static (i.e. are not translatable along the Y orientation), a substantially lower overall friction is experienced by belt 202 across the array 204 of rollers than if several rollers were translatable along the Y orientation to apply the biasing force, such as if the biasing force were applied at second end 201B of belt zone BZ (adjacent rollers 225, 227, 210).

Accordingly, upon applying a tension-based biasing force ($F_{SP}$) to roller 224, the force is applied in a direction (D) that is generally opposite from the direction in which the belt 202 extends away from the first roller 206 (i.e. the drive roller) at which the wiping zone (W) is located.

In some examples, because the biasing force ($F_{SP}$) is applied at the generally centrally located roller 224 where more space is available (rather than if the biasing force was applied at one of the ends of the belt zone where space is more limited), springs 246A, 246B having a greater length can be used. This ability to use longer springs 246A, 246B, in turn, enables a lower force to be applied for a given distance of elongation (or shortening) of spring, which in turn, enables adjusting the applied tension in smaller increments. By limiting the tension to smaller increments through larger elongations of the springs 246A, 246B, it becomes less likely that undesired lateral walking of the belt 202 relative to rollers of array 204 will occur due to dimensional variation in the parts comprising the wipe assembly 200. Accordingly, a longer spring length allows the nominal tension to be set closer to its minimum allowable level because variation in the spring length due to part variation does not dramatically impact the resultant applied tension to the web belt 202.

In another aspect, the wiping assembly 200 is apportionable into a static portion (labeled STATIC in FIG. 5) and a dynamic portion (labeled DYNAMIC in FIG. 5). The dynamic portion includes translatable roller 224 and a segment of belt portions 203A, 203B while static portion includes static rollers (i.e. non-translatable) 225, 227, 210, 206, 207, 208 and a segment of belt portions 203A, 203B as well as the entire belt portions 203F, 203G, 203C, 203E, 203D extending generally from roller 206 and through roller 225 and roller 227. As shown in FIG. 5, a dashed line R symbolically divides the assembly 200 into the dynamic portion (i.e. to the left of line R) and the static portion (i.e. to the right of line R).

In some examples, the length or footprint of the wiping assembly 200 defined between the first and second ends 201A, 201B of the belt zone BZ is identified as L1. However, the overall length of the belt 202 is the sum of twice the length L1 and approximately twice the length L3 from the second end 201B of the belt zone BZ to roller 224 (at the central region 201C of the belt zone (BZ).

In some examples, the overall length of belt 202 is longer than shown in FIG. 5 such that the distance L3 (distance from roller 224 to roller 220, 222) is increased. However, in some examples, the overall length of belt 202 is shorter than shown in FIG. 5 such that the distance L3 (distance from roller 224 to roller 220, 222) is decreased. In either case, the roller 224 remains located generally intermediately between the respective first and second ends 201A, 201B of the belt zone BZ to enable application of biasing force ($F_{SP}$) in the manner generally described throughout the present disclosure.

Figure 6:
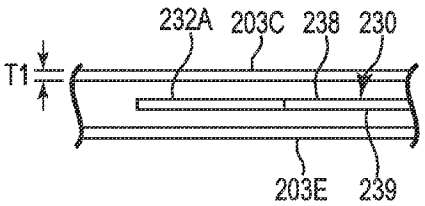
FIG. 6 is a partial side plan view schematically illustrating some components of a wiping assembly, according to one example of the present disclosure.

In some examples, as shown in FIGS. 4-5, wiping assembly 200 includes a separator 230, which is interposed between vertically spaced apart belt portions 203C and 203E that both extend indirectly from the first roller 206 in a direction away from the first end 201A of the belt zone (BZ). The separator 230 prevents inadvertent contact between belt portions 203C and 203E. In one example, separator 230 includes a generally planar sheet having a low-friction top surface 238 and a low-friction bottom surface 239 to prevent frictional engagement of belt portions 203C and 203E relative to each other, which would otherwise produce an undesirably high degree of friction because of the generally higher friction material used to form the at least partially absorbent belt 202. In some examples, the low-friction surfaces comprise a non-stick material or coating. FIG. 6 is an enlarged partial side plan view that further illustrates the relative positions of top surface 238 and bottom surface 239 of separator 230, which maintain a low friction environment for movement of the lower and upper belt portions 203C, 203E relative to each other. FIG. 6 also illustrates a thickness (T1) at portion 203C of belt 202. In one example, the thickness (T1) of belt 202 is generally uniform throughout a length of belt 202.

While at least FIGS. 4-6 illustrate the wiping assembly 200 as having a generally horizontal orientation with most portions of belt 202 extending in a generally horizontal orientation, it will be understood that operation of wiping assembly 200 does not strictly depend on the wiping assembly 200 being in a generally horizontal orientation. Rather, in some examples, the wiping assembly 200 can be positioned to extend in a generally vertical orientation in which most portions of belt 202 extend in a generally vertical orientation. Moreover, in some examples, the wiping assembly 200 can be positioned to extend in an angled orientation between a generally horizontal orientation and a generally vertical orientation.

Figure 7:
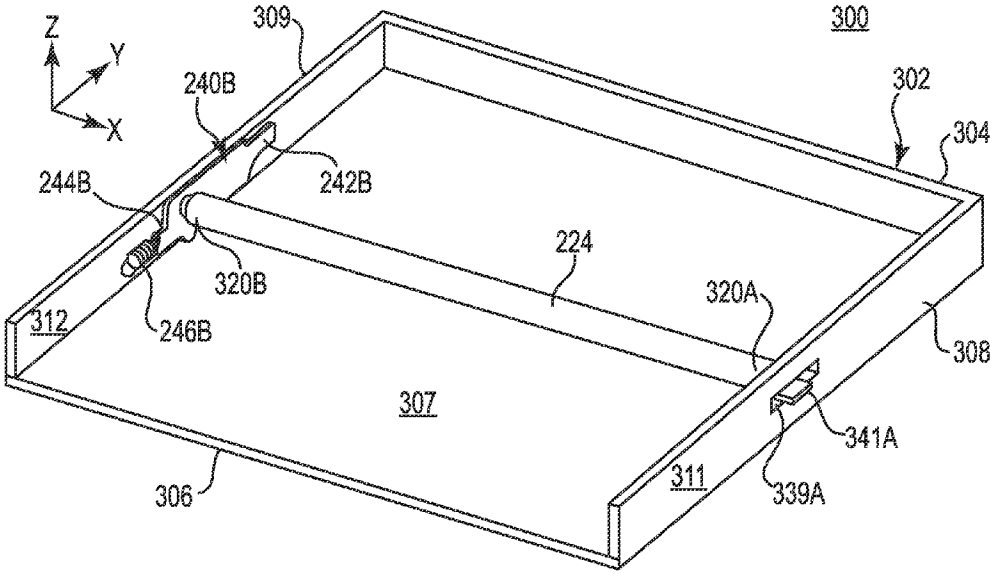
FIG. 7 is a perspective view schematically illustrating some components of a wiping assembly, according to one example of the present disclosure.

FIG. 7 is a perspective view schematically illustrating components of wiping assembly 300, according to one example of the present disclosure. In one example, wiping assembly 300 includes substantially the same features as wiping assembly 200, as previously described and illustrated in association with at least FIGS. 1-6, except further including a frame 302 for supporting elongate roller 224, among other rollers (not shown for illustrative clarity).

As shown in FIG. 7, in one example frame 302 includes a back portion 304 and an opposite front portion 306 with bottom portion 307 extending therebetween. Frame 302 further includes a first side 308 and an opposite second side 309 with bottom portion 307 extending therebetween. In one example, the first and second sides 308, 309 each include a side wall 311, 312, respectively.

In some examples, frame 302 forms a portion of a sled or positioner, such as the sled 140 in FIG. 3 or the positioner 34 in FIG. 2A.

As shown in FIG. 7, just one bracket 240B of the tensioning mechanism 241 adjacent end 320B of roller 224 is visible. However, the bracket 240B and spring 246B adjacent end 320B of roller 224, as depicted in FIG. 7, are representative of a corresponding bracket 240A and spring 246A present at the other end 330A of roller 224 but not visible in FIG. 7.

In another aspect, while not shown for illustrative simplicity, it would be understood by one skilled in the art that a free end of springs 246A, 246B (with just spring 246B visible in FIG. 7) would be secured to a second frame portion (not shown) to maintain the desired tension on springs 246A, 246B and therefore on belt 202 extending about at least roller 224 (FIGS. 4-5).

As further shown in FIG. 7, the side wall 311 of frame 302 includes a slot 339A to guide and permit translation of a protrusion 341A extending from, and associated with, bracket 240A. This arrangement permits translation of end 320A of roller 224 along the Y orientation to allow for the desired tension to be applied. Although not visible in FIG. 7, a similar slot-and-protrusion arrangement associated with bracket 240B is provided at the other end of roller 224 to allow a corresponding translation of end 320B of roller 240. These slot-and-protrusion arrangements are further illustrated later in association with at least FIG. 10.

Figure 8:
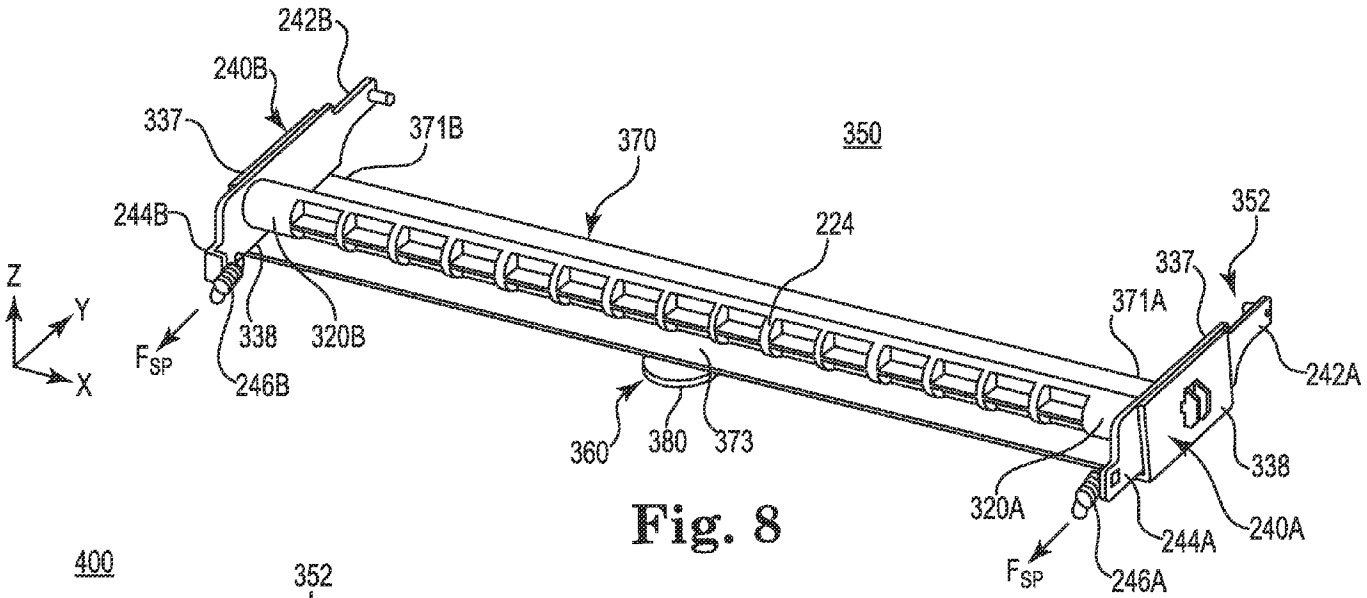
FIG. 8 is a perspective view schematically illustrating some components of a wiping assembly, according to one example of the present disclosure.

FIG. 8 is a perspective view schematically illustrating components of a wiping assembly 350, according to one example of the present disclosure. In one example, wiping assembly 350 includes at least some of substantially the same features and attributes as wiping assembly 200, 300, as previously described in association with FIGS. 4-5 and 7, except further including a generally central rotational mechanism 360. In general terms, the rotational mechanism 260 enables rotation of roller 224 in the X-Y plane to automatically balance tension between the ends 320A, 320B of the roller 224 and therefore balance tension between opposite side edges 205A, 205B of belt 202. This tension balancing, in turn, minimizes lateral walking of belt 202 along the length of the rollers about which the belt 202 is mounted.

As shown in FIG. 8, in one example, the rotational mechanism 360 includes a platform 370 and a pivot member 380 connected to and extending from the platform 370. The platform 370 includes a first end 371A and an opposite second end 371B, with platform having a length substantially equal to a length of roller 224 that extends between brackets 240A, 240B. As shown in FIG. 8, each bracket 240A, 240B further includes a top portion 337 and a bottom portion 338 with an end 371B of platform 370 secured adjacent bottom portion 338 of bracket 240B and end 371A of platform 370 secured adjacent bottom portion 338 of bracket 240A.

The pivot member 380 is located at a generally central location 373 along platform 370 between ends 371A, 371B. As further illustrated in FIGS. 9 and 10, pivot member 380 is sized and shaped to be coupled to platform 370 and having a portion to slidably engage a slot within a frame, such as the bottom portion 307 of the frame 302 shown in FIG. 7. Accordingly, in some examples, a slot in the bottom portion 307 of frame 302 comprises a portion of the rotational mechanism 360. While pivot member 380 can take a variety of forms, in some examples, as shown in FIG. 9, pivot member 380 comprises a generally disc-shaped member.

Figure 10:
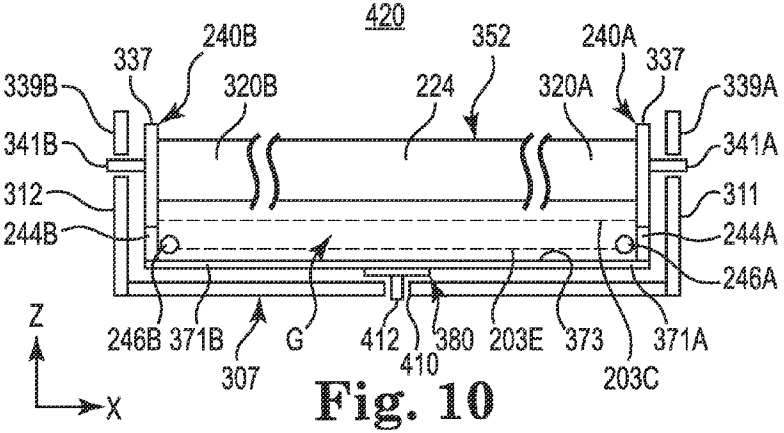
FIG. 10 is a front sectional view schematically illustrating a portion of a wiping assembly, according to one example of the present disclosure.
Figure 9:
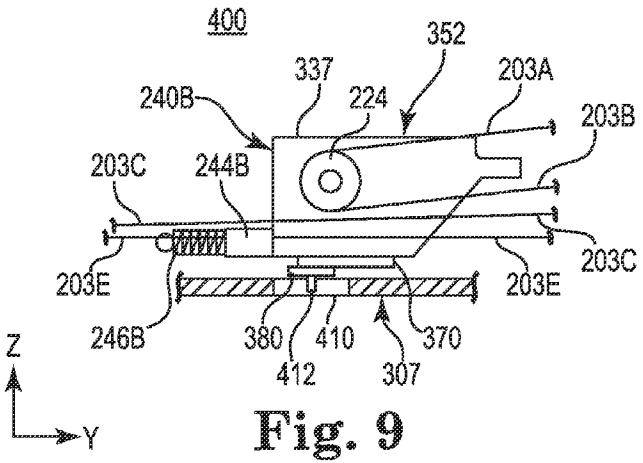
FIG. 9 is a partial sectional side view schematically illustrating a portion of a wiping assembly, according to one example of the present disclosure.

FIG. 9 is a diagram 400 including a partial sectional side view that further schematically illustrates wiping assembly 350, according to one example of the present disclosure. FIG. 10 is a diagram 420 including a front plan view that further schematically illustrates wiping assembly 350, according to one example of the present disclosure.

As shown in FIG. 10, platform 370 is vertically spaced below roller 224 to define a gap G, which has spacing sufficient to allow two vertically spaced portions 203C, 203E of belt 202 to extend through gap G. FIG. 9 further depicts these elements in a sectional side view. FIGS. 9 and 10 further illustrate the connection of pivot member 380 on the generally central region 373 of platform 370. In one example, as shown in both FIGS. 9 and 10, pivot member 380 includes a pin or protrusion 412 that is sized and shaped to extend into, and be slidably movable through, a groove or elongate slot 410 in a bottom portion 307 of frame 302. As best seen in FIG. 9, the elongate slot 410 extends along the Y orientation to guide translation of platform 370, roller 224, and bracket 240B along the Y orientation. This translational ability facilitates application of a biasing force (e.g. $F_{SP}$ in FIGS. 4-5) along the Y orientation, to apply tension to belt 202 about roller 224 and consequently about the other rollers of array 204. At the same time, the protrusion 412 is rotatable within slot 410 to enable rotation of pivot member 380 in the X-Y plane, which in turn causes a corresponding rotation of platform 370 and roller 224 in the X-Y plane.

In one aspect, by providing the pivot member 380 at the generally central region 373 of platform 370 and roller 224 and by providing the biasing forces $F_{SP}$ at the opposite outer ends 320A, 320B of roller 224, the rotational mechanism 360 provides a way for wiping assembly 350 to automatically adjust to, and mitigate, undesired migration of belt 202 (i.e. walking) laterally toward one or the other end 320A, 320B of roller 224. Moreover, by arranging platform 370 at a vertically spaced distance from roller 224, this arrangement does not interfere with the passage of web segments 203C, 203E through this portion of the wiping assembly.

FIG. 10 also further illustrates the slot-and-protrusion arrangement (see slot 339A and protrusion 341A in FIG. 7) that facilitates translation of bracket 240A, 240B, and therefore roller 224, along the Y orientation.

Figure 11:
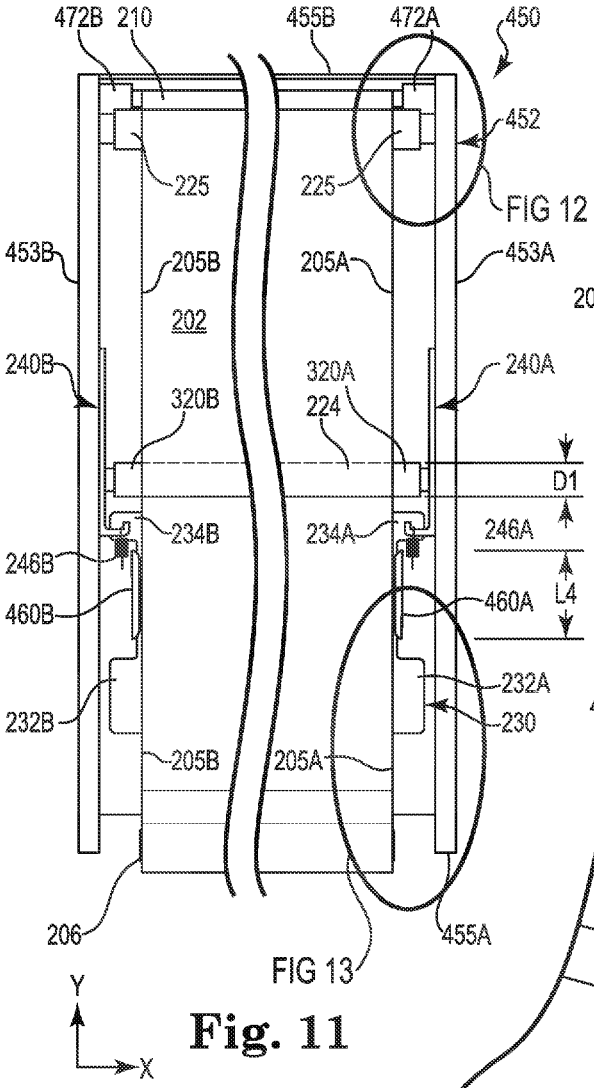
FIG. 11 is a top plan view schematically illustrating a wiping assembly, according to one example of the present disclosure.

FIG. 11 is a top plan view schematically illustrating a wiping system 450, according to one example of the present disclosure. In one example, the wiping system 450 comprises at least some of substantially the same features and attributes as wiping assembly 200, as previously described in association with at least FIGS. 4-5, with like elements identified via like reference numerals.

In one example, wiping system 450 includes a frame 452 for supporting the array 204 of rollers, belt 202, and associated components (e.g. brackets 240A, 240B, springs 246A, 246B) of the previously described wiping assembly 200. As shown in FIG. 11, frame 452 includes opposite side walls 453A, 453B and opposite end portions 455A, 455B with at least end portion 455B extending between the opposite side walls 453A, 453B.

As in the example wiping assembly 300 of FIG. 7, the side walls 453A, 453B of frame 452 in FIG. 11 support brackets 240A, 240B and enable translation of those brackets solely in the Y orientation to facilitate application of tension via springs 246A, 246B to belt 202 at roller 224.

Figure 12:
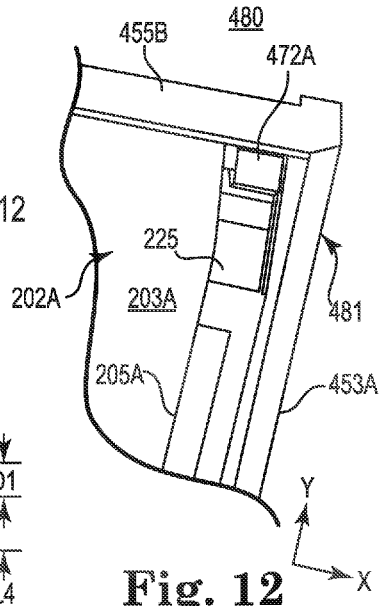
FIG. 12 is a partial perspective view schematically illustrating a portion of the wiping assembly of FIG. 11, according to one example of the present disclosure.

FIG. 12 is a diagram 480 including an enlarged partial perspective view schematically illustrating a portion 481 of the wiping assembly 450 identified via circle 12 in FIG. 11, according to one example of the present disclosure. As shown in FIG. 12, portion 481 includes side portion 453A and end portion 455B of frame 452 supporting the array 204 of rollers and in particular, supporting rollers 225, 227 near end portion 455B. As in prior Figures, belt 202 extends about rollers 225, 227 in a pattern such as that shown in FIGS. 4-5. In one example, the portion 481 of wiping assembly 450 includes a barrier 472A to prevent lateral migration of side edge 205A of belt 202 along the X orientation. While not shown in FIG. 12, it will be understood that FIG. 12 is representative of a second barrier 472B located at an opposite end of each of rollers 225, 227 that is provided to prevent or mitigate lateral migration (i.e. walking) of side edge 205B of belt 202. In one example, the barriers 472A, 472B comprise a generally rectangular block-shaped member sized to extend from side wall 453A (or side wall 453B respectively) of frame 302 to a point closely adjacent an edge 205A (or edge 205B, respectively) of belt 202.

Figure 13:
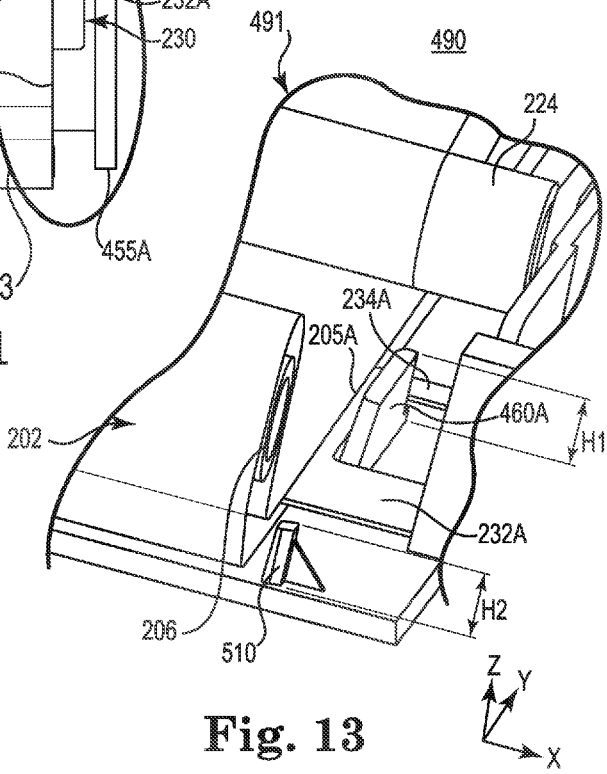
FIG. 13 is a partial perspective view schematically illustrating a portion of the wiping assembly of FIG. 11, according to one example of the present disclosure.

FIG. 13 is a diagram 490 including an enlarged partial perspective view schematically illustrating portion 491 of the wiping assembly 450 identified via ellipse 13 in FIG. 11, according to one example of the present disclosure. As shown in FIG. 13, portion 491 of wiping assembly 450 includes the belt 202, rollers 206 and 224 that were previously described and illustrated in association with at least FIGS. 4-5 and 7. In one example, wiping assembly 450 further includes a barrier 460A disposed adjacent side edge 205A of belt 202 and intermediate between roller 206 and roller 224.

As further shown in FIG. 13, a barrier 510A is disposed directly lateral to an end of roller 206 to be adjacent to side edge 205A of belt 202. As shown in FIG. 13, just one barrier 510A adjacent side edge 205A of belt 202 is visible. However, the barrier 510A and its positional relation to belt 202 is representative of a corresponding barrier 510B present adjacent the other side edge 205B of belt 202 but not shown in FIG. 13.

Both barriers 460A, 510A are sized and shaped to be positioned closely adjacent to the side edge 205A of belt 202 to prevent and/or minimize lateral migration of belt 202 in the X orientation and relative to the rollers on which belt 202 extends in the Y orientation.

In one aspect, as shown in FIGS. 11 and 13, barrier 460A is positioned between two wing portions 232A and 234A of separator 230. In one example, a distance between wing portions 232A, 234A of separator 230 is generally equal to or slightly greater than a length of barrier 460A.

In some examples, as best seen in FIG. 11, barrier 460A is formed as an elongate wall having a length (L4) that is at least about two times a diameter (D1) of roller 224. In one aspect, as shown in FIG. 13, barrier 460A has a height (H1) about 3-5 times greater than a thickness (T1) of belt 202 to ensure that the belt 202 cannot jump over the barrier 460A.

In some examples, barrier 510A has a size and shape like a post, and has a height (H2) at least about 2-3 times a thickness (T1 in FIG. 6) of belt 202.

In some examples, wiping assembly 450 includes at least three barriers (e.g. barrier 472A, 460A, 510) supported by frame 452 and positioned closely adjacent each opposite edge 205A, 205B of belt 202. In some examples, wiping assembly 450 includes just one of the respective barriers 472A, 460A, 510. In some examples, wiping assembly 450 includes just two of the respective barriers 472A, 460A, 510.

Figure 14:
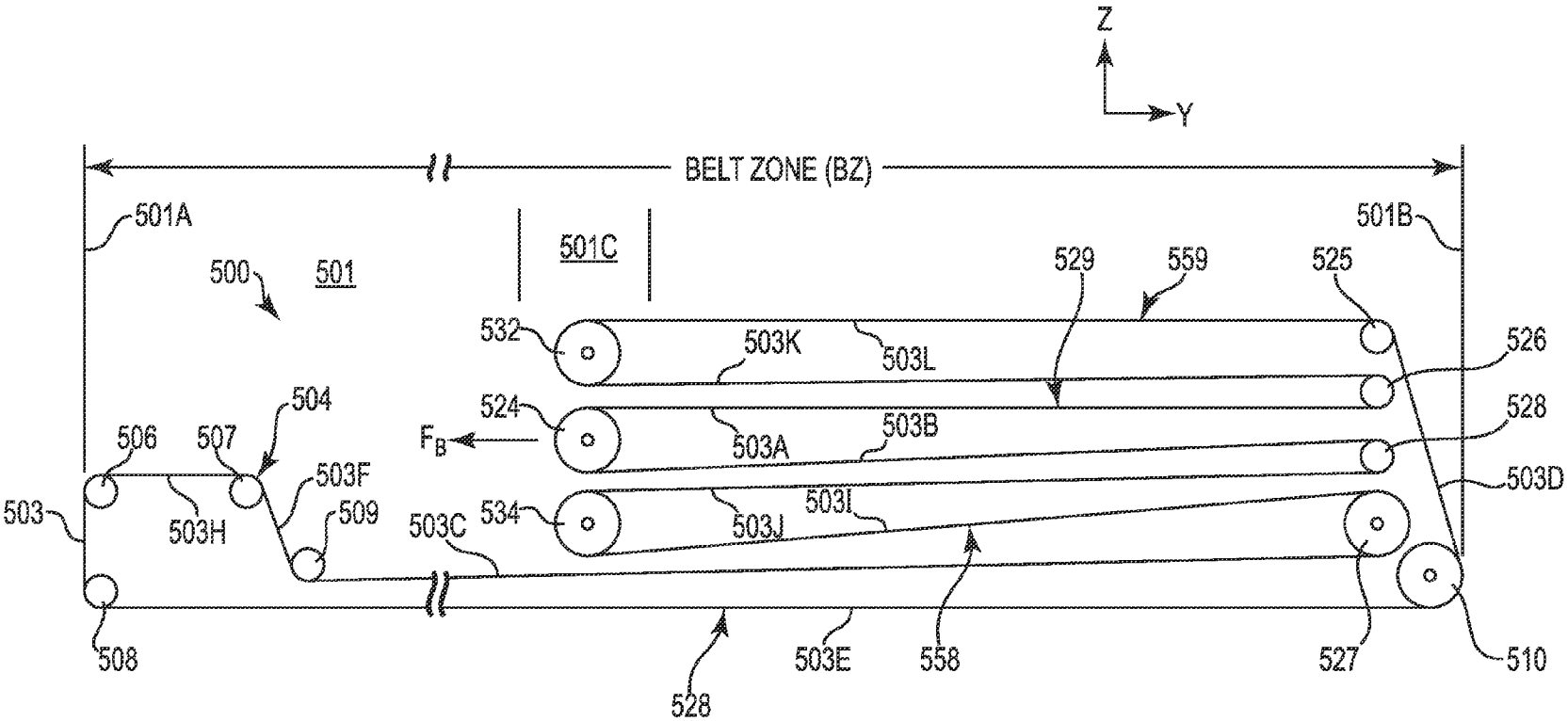
FIG. 14 is a diagram including a side plan view schematically illustrating a wiping assembly, according to one example of the present disclosure.

FIG. 14 is a diagram 501 including a side plan view of a wiping assembly 500, according to one example of the present disclosure. In one example, the wiping assembly 500 includes at least some of substantially the same features and attributes as wiping assembly 120, 200, 300, 350 450, as previously described and illustrated in association with FIGS. 1-13, respectively.

As shown in FIG. 14, wiping assembly 500 includes a belt 502 extending under tension about an array 504 of rollers arranged to configure belt 502 in a generally serpentine pattern. In one aspect, this generally serpentine pattern enables housing greater lengths of belt 502 than if belt 502 were housed in a strictly linear path.

With further reference to FIG. 14, array 504 includes rollers 506, 507, 508, 509, 510, 524, 525, 526, 527, 528, 532, and 534. At least rollers 506, 507, 508, 510, 524, 525, 527 provide at least substantially the same function as rollers 206, 207, 208, 210, 224 225, and 227 as previously described in association with FIGS. 4-5. Rollers 509, 528, 526, 534, 544 are provided to accommodate the greater length of belt 502 as compared to the length of belt 202 (FIGS. 4-5).

In some examples, a portion of belt 502 at roller 506 provides a wiping portion for wiping a headland region of a fluid ejection assembly. In some examples, belt portion 503H extending between rollers 506 and 507 provides the wiping portion. In some examples, in which the wiping assembly 500 has a generally vertical orientation, the belt portion 503G provides the wiping portion or a portion of belt at roller 506 or at roller 508 provides the wiping portion.

In some examples, at least portions 503C, 503E of belt 502 extending generally between roller 506 and roller 510 generally define a first loop portion 528 while at least belt portions 503A, 503B generally define a second loop portion, at least belt portions 5031, 503J generally define a third loop portion 558, and at least belt portions 503K, 503L generally define a fourth loop portion 559. In a manner similar to that described for second loop portion 229 of wiping assembly 200 in the diagram of FIG. 5, the second, third, and fourth loop portions 529, 558, 559 extend generally along the Y orientation (e.g., a generally horizontal orientation in one example) at least partially between the opposite ends 501A, 501B of the belt zone (BZ). Moreover, these second, third, fourth loop portions 529, 558, 559 are positioned vertically above, and spaced apart from, the first loop portion 528, which extends generally along the Y orientation (e.g. a generally horizontal orientation in one example). In one aspect, this arrangement of a multi-loop generally serpentine belt configuration provides a space-saving design in which a greater length of a wiping belt can be housed in fixed footprint (i.e. space between opposite ends 501A, 501B of belt zone BZ). At the same time, this arrangement preserves the single vector tensioning mechanism located adjacent a generally central region of a belt zone instead of a multi-vector tensioning mechanism located at an end of a belt zone.

In some examples, each roller of the array 504 is non-translatable along the Y orientation (and the Z and X orientations) except for roller 524, which is translatable along the Y orientation to be responsive to a biasing force $F_B$ exerted on roller 524 (along the Y orientation), thereby exerting tension on belt 502 about the rollers of array 504.

It will be understood that in some examples the orientation of entire wiping assembly 500 can be positioned to have a generally vertical orientation or other angled orientation, in substantially the same manner as previously described for at least wiping assembly 200 in association with at least FIGS. 1-13.

As in the example of at least wiping assembly 200 previously described in association with at least FIGS. 4-5, wiping assembly 500 is not strictly limited to the proportion of a length of the second, third, and fourth loop portions 529, 558, 559 relative to a length of the first loop portion 528, as shown in FIG. 14. Rather, in some examples, the position of rollers 524, 532, 534 is closer to the first end 501A than second end 501B of belt zone BZ and in some examples, the position of rollers 524, 532, 534 is closer to second end 501B than first end 501A of belt zone BZ.

In some examples, additional loop portions similar to second, third, and fourth loop portions 529, 558, 559 are added to further increase an overall length of belt 502 which maintaining the space-saving generally serpentine configuration.

Figure 15:
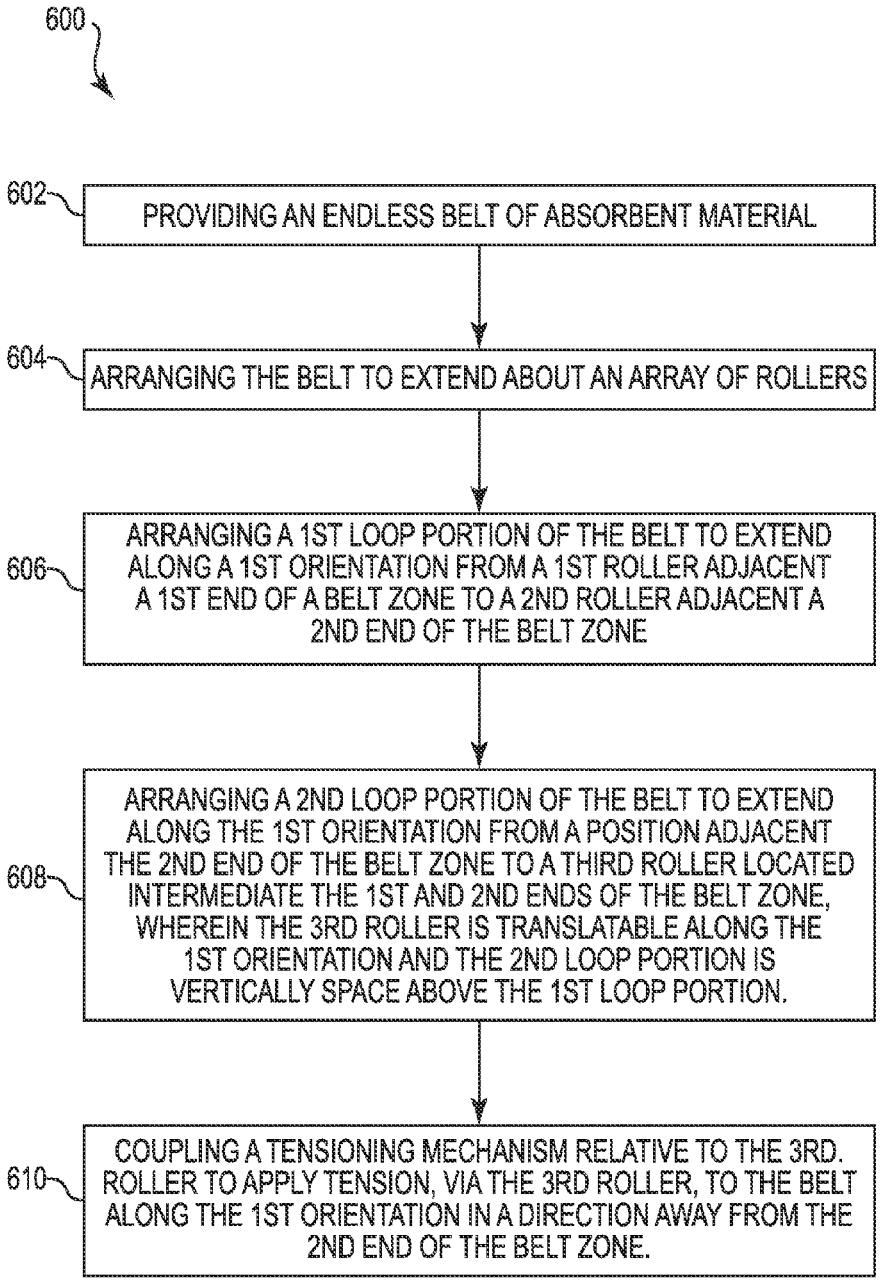
FIG. 15 is a flow diagram of a method of manufacturing a wiping assembly, according to one example of the present disclosure.

FIG. 15 is a flow diagram of a method 600 of manufacturing a wiping system for a printing system, according to one example of the present disclosure. In some examples, method 600 is performed using at least some of the elements, components, modules, and system previously described in association with at least FIGS. 1-14. In some examples, method 600 is performed using at least some elements, components, modules, and system other than those previously described in association with at least FIGS. 1-14.

In one example, as shown at 602 in FIG. 15, method 600 includes providing an endless belt of an at least partially absorbent material. At 604, method 600 includes arranging the belt to extend about an array of rollers. In one aspect, in this context the terms "providing" or "arranging" does not necessarily mean actual manufacturing of the rollers and/or of the endless belt. Rather, the terms "providing" or "arranging" includes, but is not limited to, merely obtaining a belt and/or rollers or merely preparing the belt and/or rollers for arrangement in the wiping assembly.

This arranging includes, at 606, arranging a first loop portion of the belt to extend along a first orientation from a first roller adjacent a first end of a belt zone to a second roller adjacent a second end of the belt zone. At 608, the arranging includes arranging a second loop portion of the belt to extend along the first orientation from a position adjacent the second end of the belt zone to third roller located intermediate the first and second ends of the belt zone, wherein the third roller is translatable along the first orientation and the second loop portion is vertically spaced above the first loop portion. At 610, method 600 includes coupling a tensioning mechanism relative to the third roller to apply tension, via the third roller, to the belt along the first orientation in a direction away from the second end of the belt zone.

At least some examples of printing systems in the present disclosure are directed to a wiping assembly to wipe a fluid ejection assembly, such as a printhead assembly. In some examples, the wiping assembly includes an endless belt mounted about an array of rollers with a portion of the belt on one of the rollers being used for wiping the fluid ejection assembly. In some examples, at least some features of the wiping assembly minimize lateral shifting (i.e. walking) of the belt relative to the rollers on which the belt is mounted. In some examples, this lateral shifting of the belt is minimized via a particular arrangement the rollers and a particular location at which tension is applied to the belt (about the rollers), which in turn reduces the overall tension applied on the belt about the rollers. In some examples, such lateral shifting of the belt is minimized via barriers positioned adjacent side edges of the belt.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this present disclosure be limited only by the claims and the equivalents thereof.

What is claimed is:

1. A wiping assembly for a fluid ejection device, comprising:

a plurality of rollers about which an endless belt is mounted, including:

a first roller mounting a first end of the belt adjacent a first end of a belt zone;

a second roller adjacent at an opposite, second end of the belt zone; and a third roller mounting a second end of the belt and located at an intermediate position along a first orientation between the respective first and second ends of the belt zone, wherein the third roller is translatable along the first orientation while the first roller and the second roller are non-translatable along the first orientation, and wherein the third roller is biased toward the first end of the belt zone.

2. The wiping assembly of claim 1, wherein portions of the belt extend from the third roller at the intermediate position to the second end of the belt zone and are vertically spaced above portions of the belt extending from a position adjacent the second end of the belt zone to the first end of the belt zone adjacent the first roller.

3. The wiping assembly of claim 1, wherein a majority of a length of the belt extends in a plane generally parallel to a generally horizontal orientation along the Y orientation.

4. The wiping assembly of claim 1, wherein the belt includes a first portion and a second portion both extending along the first orientation from the first end of the belt zone adjacent the first roller and wherein the first portion is vertically spaced from, and generally parallel to, the second portion, wherein the wiping assembly further comprises:

a non-stick sheet interposed between the respective first and second portions of the belt.

5. The wiping assembly of claim 1, comprising:

a fourth roller interposed between the second roller and the third roller, wherein the fourth roller is located adjacent the second end of the belt zone and is non-translatable along the first orientation; and a fifth roller interposed between the third roller and the first roller, wherein the fifth roller is located adjacent the second end of the belt zone and is non-translatable along the first orientation.

6. The wiping assembly of claim 1, comprising:

a sled slidably movable relative to the fluid ejection device, wherein the sled includes at least one pair of barriers on opposite side edges of the belt to contain lateral translation of the belt relative to a length of the rollers.

7. The wiping assembly of claim 1, comprising:

a rotational mechanism coupled to the third roller to enable rotational movement of the third roller, in a plane generally parallel to both the respective first and second orientations, when a biasing force is applied at each of opposite end of the third roller.

8. The wiping assembly of claim 1, wherein the endless belt includes:

a first loop portion extending in a first direction from the first roller at the first end of the belt zone, toward and about the second roller at the second end of the belt zone; and a second loop portion extending in an opposite second direction from the second roller at the second end of the belt zone toward and to the third roller at the second end of the belt, wherein the second loop portion has a length about one-half a length of the first loop portion.

9. A printing system comprising:

a wiping assembly comprising an endless belt and a plurality of rollers about which the belt is mounted, the rollers including:

a first roller mounting a first end of the belt adjacent a first end of a belt zone, a second roller adjacent a second end of the belt zone, and a third roller mounting a second end of the belt adjacent an intermediate position between the respective first and second ends of the belt zone, wherein the third roller is translatable along a first orientation extending generally between the first and second ends of the belt zone while the first roller and the a second roller are non-translatable along the first orientation, and wherein the third roller is biased toward the first end of the belt zone to exert tension on the belt about the rollers; and a frame supporting the wiping assembly and positionable to enable selective relative movement between a printhead assembly and the wiping assembly to cause wiping of the printhead assembly via a portion of the belt on the first roller.

10. The printing system of claim 9, wherein the frame includes a first side and an opposite second side, and the frame supports:

a pair of first barriers intermediate to the first roller and the third roller, each first barrier being in close proximity to a respective one of first and second opposite edges of the belt to limit movement of the belt in a second orientation generally perpendicular to the first orientation.

11. The printing system of claim 10, wherein the frame supports:

a second barrier along the first loop portion adjacent the first end of the belt zone; and a third barrier along the first loop portion adjacent the second end of the belt zone, wherein each respective second barrier and third barrier is in close proximity to each of the respective first and second opposite edges of the belt to limit migration of the belt in a second orientation generally perpendicular to the first orientation.

12. The printing system of claim 10, wherein a portion of the belt, extending from the first roller to a midportion of the belt zone between the first and second ends of the belt zone, defines a first belt segment and a second belt segment vertically spaced above the first belt segment, and wherein the wiping assembly comprises:

a separator sandwiched between the respective first and second belt segments and having a length extending along the first orientation between the first roller and the midportion of the belt zone, wherein the separator includes a pair of opposite low-friction surfaces.

13. The printing system of claim 9, comprising a tensioning mechanism including:

a first bracket disposed adjacent a first side of the frame and including a first portion coupled to a first end of the third roller and a second portion;

a second bracket disposed adjacent an opposite second side of the frame and including a first portion coupled to an opposite second end of the third roller and a second portion, wherein the second portion of each respective first and second bracket is supported by the frame while being slidably movable relative to the frame along the first orientation to enable translation of the third roller along the first orientation;

a first biasing element coupled, via the second portion of the first bracket, to a first end of the third roller and located adjacent to a first edge of the belt; and a second biasing element coupled, via the second portion of the second bracket, to an opposite second end of the third roller and located adjacent to an opposite second edge of the belt.

14. The printing system of claim 13, comprising:

a pivot member coupled relative to a generally central region of the third roller and rotatable to permit automatically self-adjusting rotation of the third roller about a vertical axis and generally parallel to both the first and second orientations, wherein the pivot member includes a protrusion slidably movable relative to a portion of the frame along the first orientation to guide translation of the third roller along the first orientation.

15. A method of manufacturing a wiping assembly for a printing system, the method comprising:

providing an endless belt of at least partially absorbent material;

arranging the belt to extend about an array of rollers, including:

arranging a first loop portion of the belt to extend along a first orientation from a first elongate roller adjacent a first end of a belt zone to a second elongate roller adjacent an opposite second end of the belt zone; and arranging a second loop portion of the belt to extend along the first orientation from a position adjacent the second end of the belt zone to a third roller located intermediate the first and second ends of the belt zone, wherein the third roller is translatable along the first orientation, and wherein the second loop portion is vertically spaced above the first loop portion; and coupling a tensioning mechanism relative to the third roller to apply tension, via the third roller, to the belt along the first orientation in a direction away from the second end of the belt zone.

16. The method of claim 15, wherein both the first and second rollers are non-translatable along the first orientation.

17. The method of claim 15, wherein coupling the tensioning mechanism comprises:

arranging a first biasing element adjacent to a first end of the third roller and to a first edge of the belt; and arranging a second biasing element adjacent to an opposite second end of the third roller and to an opposite second edge of the belt, wherein both the first and second biasing elements apply the tension in the direction away from the second end of the belt zone.

18. The method of claim 17, comprising:

coupling a pivot member relative to a generally central region of the third roller.

19. The method of claim 17, comprising:

arranging at least one barrier in close proximity to each of the respective first and second opposite edges of the belt to limit shifting of the belt in a second orientation generally perpendicular to the first orientation.

20. The method of claim 19, wherein at least one barrier comprises a plurality of barriers and arranging the at least one barrier includes:

positioning a first barrier along the first loop portion of the belt and intermediate to the first roller and the third roller;

positioning a second barrier along the first loop portion adjacent the first end of the belt zone; and positioning a third barrier along the first loop portion adjacent the second end of the belt zone.

* * * * *

UNITED STATES PATENT AND TRADEMARK OFFICE

CERTIFICATE OF CORRECTION

PATENT NO. : 8,899,722 B2
APPLICATION NO. : 13/740492
DATED : December 2, 2014
INVENTOR(S) : Steve A. O'Hara et al.

It is certified that error appears in the above-identified patent and that said Letters Patent is hereby corrected as shown below:

In the claims

In column 16, line 67, in Claim 9, delete "the a" and insert -- the --, therefor.

Signed and Sealed this
Twenty-first Day of July, 2015

Michelle K. Lee

Michelle K. Lee
*Director of the United States Patent and Trademark Office*